United States Patent [19]

Schoch

[11] Patent Number: 5,042,177

[45] Date of Patent: Aug. 27, 1991

[54] ROTARY CLOSURE FOR A SPORTS SHOE, ESPECIALLY A SKI SHOE

[75] Inventor: Robert Schoch, Hilzingen, Fed. Rep. of Germany

[73] Assignee: Weinmann GmbH & Co. KG, Fed. Rep. of Germany

[21] Appl. No.: 548,578

[22] Filed: Jul. 5, 1990

[30] Foreign Application Priority Data

Aug. 10, 1989 [DE] Fed. Rep. of Germany ..... 3926514

[51] Int. Cl.[5] ..... A43B 5/04; A43B 5/16

[52] U.S. Cl. ..... 36/117; 36/50

[58] Field of Search ..... 36/50, 117, 118, 119, 36/120, 121

[56] References Cited

U.S. PATENT DOCUMENTS

| | | | |
|---|---|---|---|
| 4,633,599 | 1/1987 | Morell et al. | 36/50 |
| 4,653,204 | 3/1987 | Morell et al. | 36/50 |
| 4,669,201 | 6/1987 | Pozzobon | 36/50 |
| 4,748,726 | 6/1988 | Schoch | 36/50 |
| 4,796,829 | 1/1989 | Pozzobon et al. | 36/50 |
| 4,799,297 | 1/1989 | Baggio et al. | 36/50 |
| 4,841,649 | 6/1989 | Baggio et al. | 36/117 |

FOREIGN PATENT DOCUMENTS

| | | | |
|---|---|---|---|
| 0132744 | 2/1985 | European Pat. Off. | 36/50 |
| 0264712 | 4/1988 | European Pat. Off. | 36/117 |

*Primary Examiner*—Paul T. Sewell
*Assistant Examiner*—Marie D. Patterson
*Attorney, Agent, or Firm*—Learman & McCulloch

[57] ABSTRACT

The invention relates to a rotary closure for a sports shoe, especially a ski shoe, in which at least one traction element co-operating with the closure element of the shoe can be wound onto or off of a pulley which can be rotated by an actuating shaft. A manually releasable locking arrangement fixes the actuating shaft in the chosen position of the closure. In the transmission connection between the actuating shaft and the pulley a releasable coupling is provided which facilitates release of the closure without it being necessary to bend down in order to actuate the locking arrangement.

13 Claims, 4 Drawing Sheets

ROTARY CLOSURE FOR A SPORTS SHOE, ESPECIALLY A SKI SHOE

FIELD OF THE INVENTION

The invention relates to a rotary closure for a sports shoe, especially a ski shoe.

BACKGROUND OF THE INVENTION

A rotary closure for a ski shoe is known from EP-A-255 869.

With this known rotary closure the closure flaps of the shoe are drawn together or loosened by means of traction cable tensioning members. The traction cable tensioning members are wound on or off of a pulley which is rotatable by hand by means of an actuating shaft.

In order to maintain a predetermined setting a locking arrangement is provided. Extremely sensitive adjustment of the rotary closure is possible through a large number of locking positions. The locking arrangement is released by a short turn in the opposite direction to the direction of rotation for tightening.

In order to release the closure for the purpose of actuating the locking arrangement it is necessary for the user to bend down.

The object of the invention therefore is to make further developments to a rotary closure of the type described above in such a way that it is possible to release the closure without the user having to bend down for the purpose of actuating the locking arrangement.

SUMMARY OF THE INVENTION

This object is achieved according to the invention by providing a rotatable pulley for winding/unwinding a traction element connected to a closure element of the shoe and an actuating shaft having a handle thereon rotatable by hand for rotating the pulley wherein the actuating shaft is axially movable independently of the handle. The actuating shaft is releasably held in a particular rotary position representative of a chosen position of the shoe closure element by a manually releasable locking mechanism. A planetary gear type transmission between the actuating shaft and the pulley transmits rotary movement of the shaft to the pulley and includes a releasable coupling that disengages the pulley from the shaft upon axial movement thereof to release the pulley for rotation to unwind the traction element.

In this construction according to the invention it is possible for the user to be in the upright position to actuate a release element which releases the pulley from the actuating shaft which is fixed by the locking arrangement.

Further advantageous embodiments of the invention are the subject matter of the subordinate claims and are explained in greater detail in connection with the examples illustrated in the drawings.

DETAILED DESCRIPTION OF THE INVENTION

Figure 1:
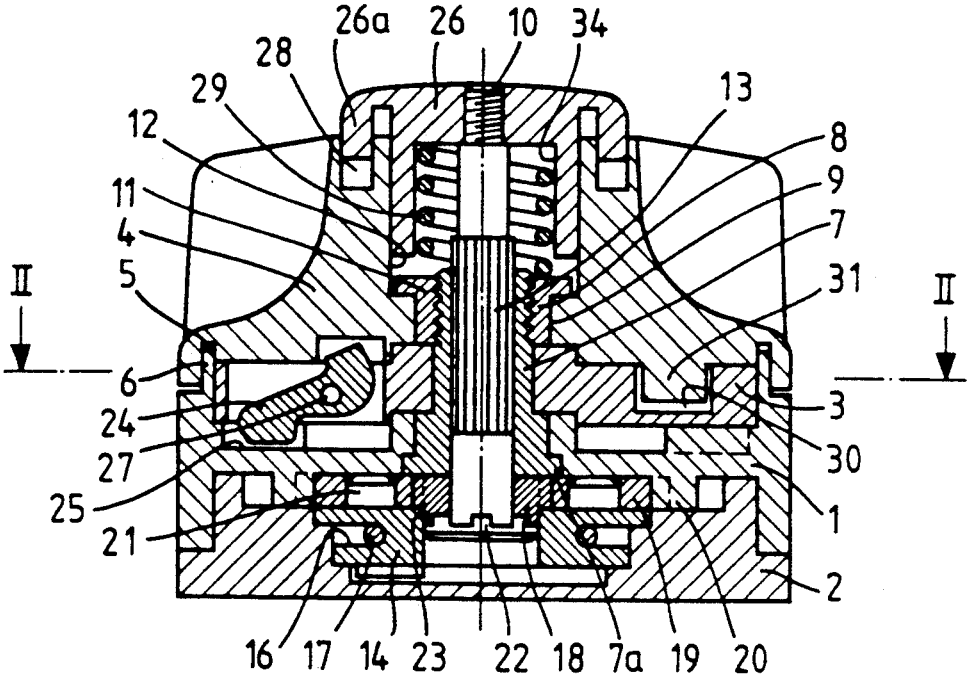
FIG. 1 shows a section through a first embodiment with the coupling closed.
Figure 2:
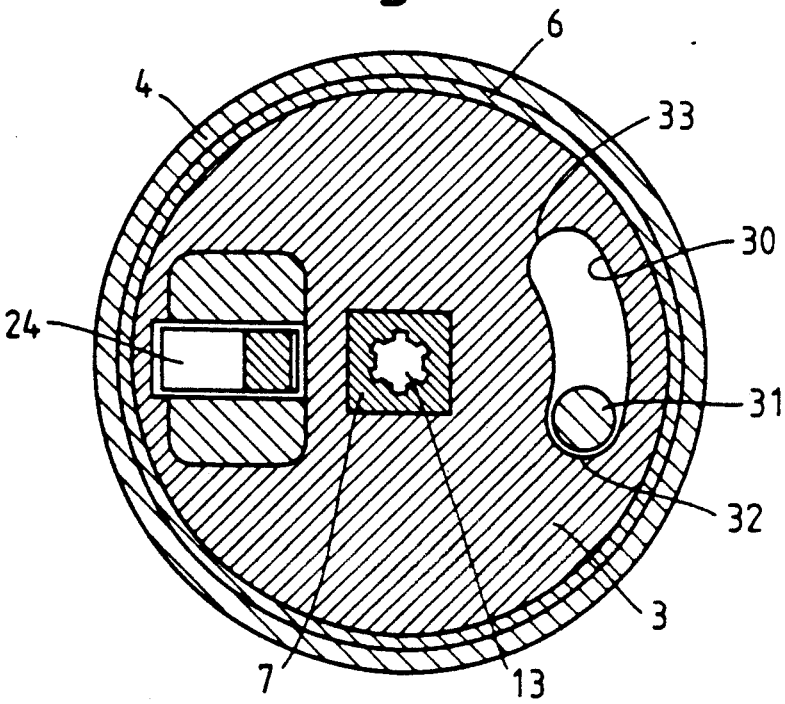
FIG. 2 shows a section through the first embodiment of FIG. 1 along the line II—II.

A first embodiment of the rotary closure will be explained in greater detail with the aid of FIGS. 1 and 2. A frame 1 of cylindrical construction is closed from below with a base 2. An intermediate disc is inserted from above into the frame 1 so as to be rotatable. Above this an actuating handle 4 is arranged which has a circular groove. A corresponding, equally circular flange 6 on the frame 1 engages in this groove 5 and thus ensures a guided rotary movement of the actuating handle 4.

The frame 1, the intermediate disc 3 and the actuating handle 4 are each provided with a central opening into which a coupling bush 7 is inserted from below. The coupling bush 7 is of cylindrical construction in the region of the frame 1 and is supported towards the top by a projection *7a* on the corresponding part of the frame 1. In the region of the intermediate disc 3 the coupling bush 7 is constructed as a square which together with the opening in the intermediate disc 3 which is constructed as an internal square constitutes a connection which is fixed against rotation. A nut 8 is screwed onto the region of the coupling bush 7 which lies above this and is again of cylindrical construction. The lower end of the nut 8 is supported on the intermediate disc 3 so that the intermediate disc 3 is fixed in its position and can only carry out a rotary movement about the central shaft 10 of the rotary closure. In the lower region the actuating handle butts with its inner bore on the nut 8. An upwards movement of the actuating handle 4 is prevented by a projection 11 on the nut 8 and the corresponding recess 12 in the actuating handle 4. An actuating shaft 13 is inserted into the coupling bush 7. The actuating shaft 13 is provided in its central region with teeth which engage in corresponding teeth of the coupling bush 7 and thus facilitate on the one hand a displacement along the shaft 10 and on the other hand a connection which is fixed against rotation to the coupling bush 7.

In the chamber formed by the frame 1 and the base 2 a cable pulley 14 is arranged concentrically around the shaft 10. The cable pulley 14 has a groove 16 running round its circumference in which a traction element 17, for example a traction cable, is accommodated for winding on or off. A planetary gear is provided between the cable pulley 14 and the frame 1 to drive the cable pulley 14. A sun wheel 18, which is arranged coaxially around the actuating shaft 13 and as a drive gear can be connected by a coupling to the actuating shaft so as to be fixed against rotation, belongs to this planetary gear. A ring gear 20 with internal toothing which is mounted so as to be fixed against rotation on the frame 1 also belongs to the planetary gear. Planet pinions 19 which are rotatably connected by pins 21 to the cable pulley 14 are provided in the region between the ring gear 20 and the sun wheel 18.

The coupling for transferring the rotary motion of the actuating shaft 13 to the cable pulley 14 is constructed as a toothed coupling and contains two coupling parts provided with teeth, of which one coupling part 22 is fixed on the lower end of the actuating shaft and the other coupling part 23 is arranged on the sun wheel 18. In this case the coupling part 23 and the sun wheel 18 are preferably of integral construction.

In a similar manner to that of the known construction according to EP-A-255 869, a locking mechanism which fixes the actuating shaft in the chosen setting of the closure is arranged in the intermediate disc 3. The locking mechanism contains a catch 24 which is mounted like a two-armed lever so as to be pivotable about a pivot pin 27. Furthermore a ring gear 25 which is arranged concentrically with the actuating shaft 10 is provided on the frame and a catch 24 which is prestressed by a spring engages in this ring gear when a rotary movement is carried out in the direction of winding the traction element 17 onto the cable pulley 14.

At the end of the actuating shaft 13 facing away from the coupling an actuating knob 26 is firmly connected to the actuating shaft 13. A circular bead 26*a* on the mushroom-shaped actuating knob 26 is guided in a corresponding groove 28 in the actuating handle so that displacement of the actuating knob 26 in the direction of the shaft 10 is possible. The actuating knob 26 receives additional guiding in the recess 12 of the actuating handle 13. A spring 29 which is supported at the bottom on the nut 8 and at the top against the actuating knob 26 is accommodated in a recess 34 of the actuating knob 26.

In order to transfer the rotary motion of the actuating handle 4 to the intermediate disc 3, the actuating handle 4 is provided with a pin 31 which engages in a recess 30 in the intermediate disc 3. The pin 31 comes into contact with a stop 32 during rotation in the direction of winding on the traction elements 17 and with a stop 33 on rotation in the direction of unwinding the traction element 17.

Figure 3:
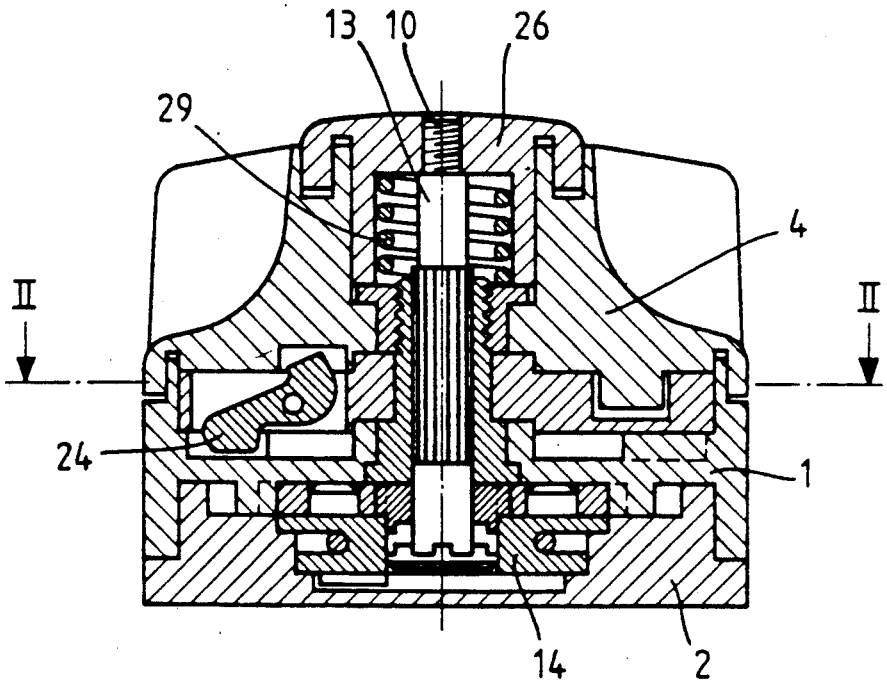
FIG. 3 shows a section through the first embodiment with the coupling open.

The way in which the first embodiment functions will be explained below with the aid of FIGS. 1 to 3.

When rotating the actuating handle 4 in the direction of winding the traction element 17 on the cable pulley 14 a certain idle path must optionally be covered initially from the stop 33 to the stop 32 before the pin 31 entrains the intermediate disc 3 in the rotary movement. Due to the initial spring tension of the catch 24 the catch comes into engagement successively with the teeth of ring gear 25 which are distributed in the circumferential direction. After the rotary movement by the actuating handle 4 has ended, the rotary position reached by the rotary closure is fixed by the engaged position of the catch 24. The coupling bush 7 which is connected to the intermediate disc 3 so as to be fixed against rotation transfers the rotary motion to the actuating shaft 13. The rotary motion is transferred via the closed coupling and the planetary gear to the cable pulley 14. The winding of the traction element 17 onto the cable pulley 14 effects tightening of the closure elements of the shoe.

The unwinding of the traction element from the cable pulley 14, i.e. the release of the closure elements of the shoe, is achieved by an opposite rotary movement of the actuating handle 4. In this case the idle path between the two stops 32 and 33 is covered first of all, so that the toothed engagement between the catch 24 and the ring gear 25 is released. By further rotation of the actuating handle 4 the traction element 17 can be unwound from the cable pulley 14.

A further possibility for releasing the cable pulley 14 for the purpose of unwinding the traction element 17 is provided by the actuating knob 26. By pressure on the actuating knob 26 the actuating shaft 13 can be displaced axially against the force of the spring 29. The actuating shaft 13 with the actuating knob 26 fixed on it is then located in the position illustrated in FIG. 3. The actuating knob 26, which at the same time forms a cover for the actuating handle 4, is limited in its movement by the nut 8. However, before this the two coupling parts 22 and 23 with their teeth have already been disengaged. This in turn means that the planetary gear and the cable pulley 14 are freely movable and the traction element 17 can relax. The pressure on the actuating knob 26 can be applied with the foot, a ski stick or other aid. In any case it is possible to circumvent the locking arrangement and achieve release of the closure elements of the shoe without having to bend down.

As soon as the pressure of the actuating knob 26 is removed, the spring 29 presses the coupling via the actuating knob 26 and the actuating shaft 13 back into its engaged position.

For the second embodiment according to FIGS. 4 to 7 the same reference numerals are used for the same parts as in the first embodiment.

A round frame 1' is connected to a housing part 35. Between them the cable pulley 14 and the gear consisting of the sun wheel 18, planetary pinions 19 and ring gear 20 are arranged in a manner analogous to that of the first embodiment. The coupling between the sun wheels 18 and the actuating shaft 13 is also made in an analogous manner in the second embodiment.

On the side of the frame 1' facing away from the cable pulley 14 and the gears an intermediate disc 3' is arranged concentrically with the shaft 10. The actuating shaft 13 is on the one hand mounted in the frame 1' so as to be rotatable and on the other hand connected to the intermediate disc so as to be fixed against rotation. The actuating shaft 13 is of hexagonal construction in the region in which it comes into contact with the intermediate disc 3', the intermediate disc 3' having a correspondingly hexagonal recess, and in this way the connection is ensured so as to be fixed against rotation.

A dome-like actuating handle 4' is provided above the intermediate disc 3'. On the outside of the frame 1' in the region of the intermediate disc 3' is a projection 1*a'*.

The actuating handle 4' is drawn downwards at the sides to such an extent that it covers the projection 1*a'* and forms a snap connection therewith.

Two pins 4'*a* and 4'*b* are arranged opposite one another approximately centrally between the centre of the actuating handle 4' and its outer periphery. If the actuating handle 4' is snapped onto the frame 1', then the two pins 4'*a* and 4'*b* project into corresponding recesses in the intermediate disc 3'.

The actuating handle 4' has around the shaft 10 an elastically deformable region 4'*c* which is connected to the end of the actuating shaft 13 facing away from the coupling.

Figure 4:
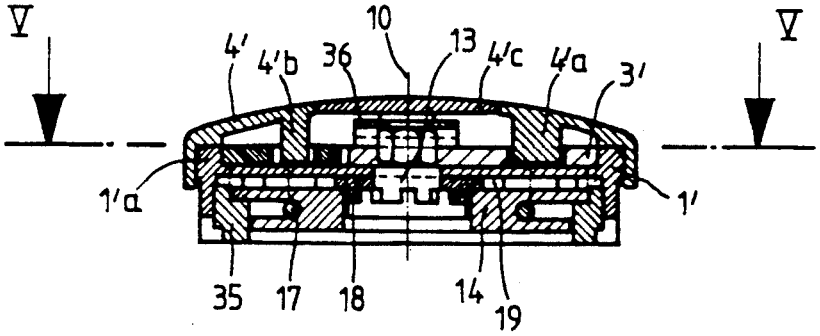
FIG. 4 shows a section through a second embodiment.
Figure 6:
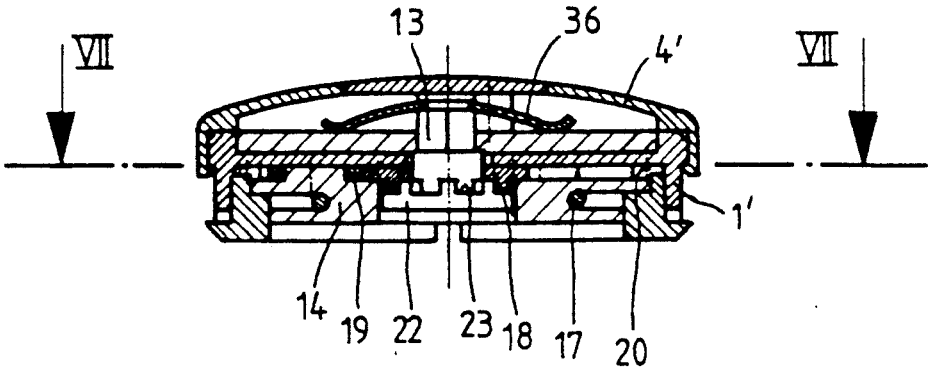
FIG. 6 shows a section through the second embodiment rotated by 90°.

The second embodiment according to FIG. 4 is shown rotated by 90° in FIG. 6. It will be seen that on the actuating shaft 13 a spring 36 constructed as a leaf spring is provided, by means of which the coupling part 22 which is firmly connected to the actuating shaft 13 is pushed into the engaged position with the coupling part 23 on the sun wheel 18.

Figure 5:
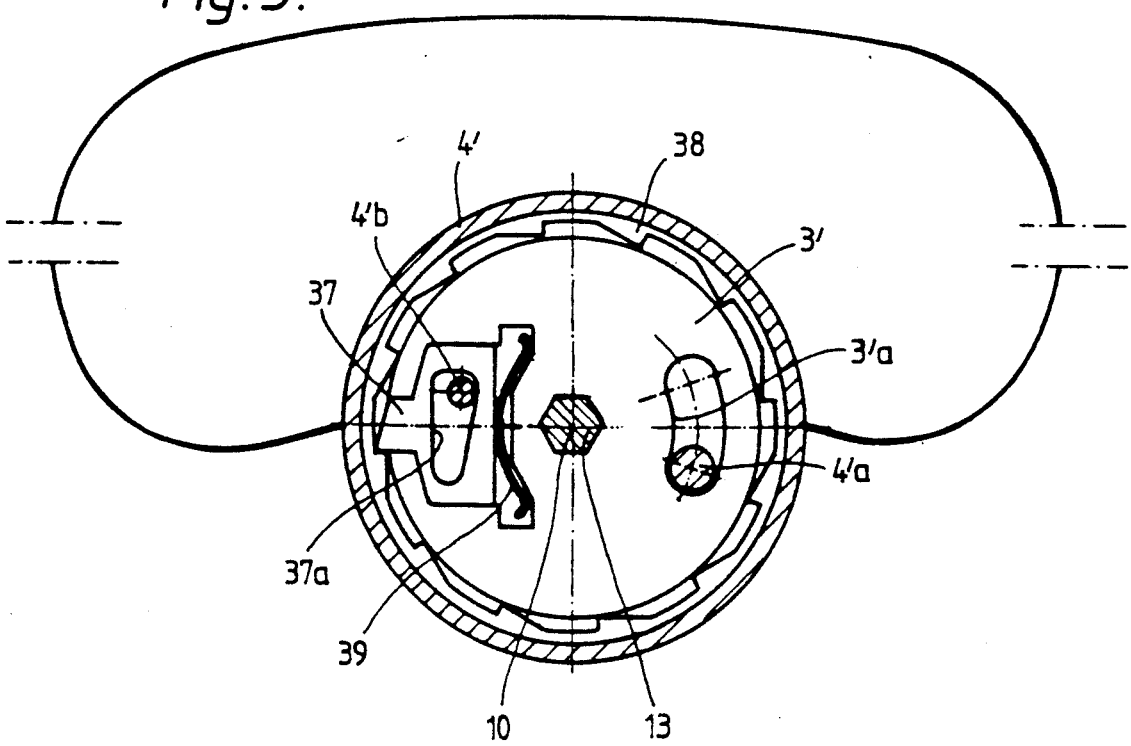
FIG. 5 shows a section through the second embodiment of FIG. 4 along the line V—V.

The construction of the locking arrangement in the second embodiment is particularly clear from the sectional view in FIG. 5. A locking slide 37 which comes into engagement with a toothed ring 38 arranged fixed on the frame 1' is provided in the intermediate disc 3'. In this embodiment the toothed ring 38 is constructed integrally with the frame 1'. A spring 39 holds the locking slide 37 in engagement with the toothed ring 38.

A rotary movement of the actuating handle 4' is transferred by the two pins 4'a and 4'b to the intermediate disc 3'. The pin 4'a is guided in a recess 3'a in the intermediate disc 3', whilst the pin 4'b engages in a recess 37a in the locking slide 37 guided in the intermediate disc 3'.

The recess 3'a in the intermediate disc 3' is constructed concentrically about the shaft 10, so that the recess 3'a only covers a small angular region.

In contrast thereto the recess 37a in the locking slide 37 has a limit which runs in a straight line particularly in the region between the pin 4'b and the central shaft 10, and the radial spacing continually increases.

Figure 7:
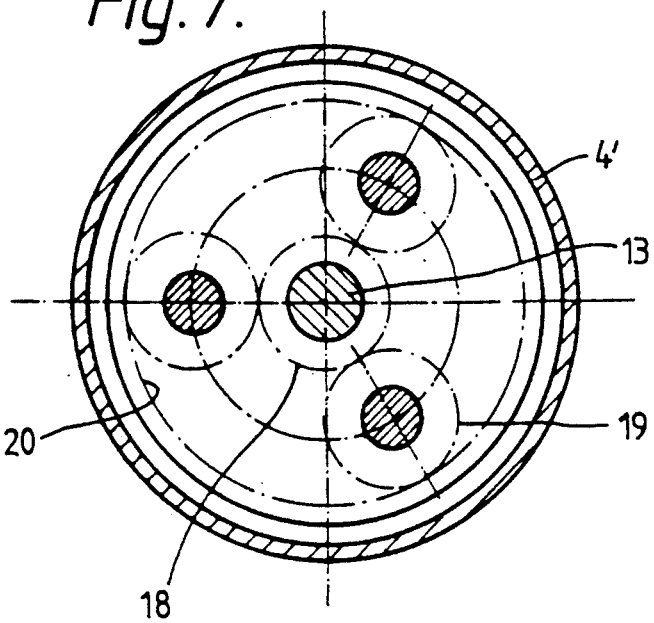
FIG. 7 shows a section through the second embodiment of FIG. 6 along the line VII—VII.

FIG. 7 shows a section along the line VII—VII of FIG. 6, and in particular illustrates the arrangement of the planetary gear.

The planetary gear of the first embodiment is constructed in the same way.

The way in which the second embodiment functions will be explained in greater detail below:

By a rotary movement of the actuating handle 4' in the clockwise direction the intermediate disc 3' is entrained by the pin 4'a and optionally also by the pin 4'b. Because the intermediate disc 3' and the actuating shaft 13 are connected so as to be fixed against rotation the cable pulley 14 is also rotated in this way be means of the planetary gear. In this case the traction element 17 constructed as a traction cable can be wound on.

In this operation the locking slide 37 slips from one tooth element of the toothed ring 38 to the next. The resulting relative movement of the locking slide 37 in relation to the intermediate disc 3' is ensured by a corresponding clearance of the pin 4'b in the recess 37a.

By the rotary movement of the actuating handle 4' the traction element 17 is wound on to the cable pulley 14 and thus effects tightening of the closure elements of the shoe. When the rotary movement is interrupted the actuating handle 4' is held firm by the locking slide 37 in the tooth element of the toothed ring 38 which was reached last. In this way the shoe can be brought carefully into the desired closed position and fixed in that position by means of the toothing on the toothed ring 38.

The unwinding of the traction element 17 from the cable pulley 14, i.e. the loosening of the closure elements of the shoe, is achieved by rotary movement of the actuating handle 4' in the opposite direction. Again, as in the first embodiment, an idle path is covered until the pin 4'a has reached the other stop in the recess 3'a. In a corresponding manner the pin 4'b also moves at the other end of the recess 37a. In this case due to the spatial arrangement of the recess 37a the locking slide 37 is pushed against the force of the spring 39 in the direction of the shaft 10. In the second end position of the pin 4'b the locking slide 37 is drawn back so far that it can no longer engage with the toothed ring 38. The fixing of the locking arrangement which is released manually in this way now facilitates further rotation of the actuating handle 4' in the anti-clockwise direction and thus effects unwinding of the traction element 17.

For renewed tightening of the closure elements of the shoe the actuating handle 4' must again be rotated in the clockwise direction, and again first of all the pins 4'a and 4'b must cover an idle path until they come to a stop at the other end of the recess 3'a or 37a respectively. If the pin 4'b reaches the stop of the recess 37a the locking slide can rest freely. Upon further rotation of the actuating handle 4' the intermediate disc 3 is then entrained, so that this rotary movement is transferred directly to the actuating shaft 10 and in this way by means of the coupling and planetary gear effects winding of the traction element 17 onto the cable pulley 14.

A further possibility for releasing the cable pulley 14 for the purpose of unwinding the traction element 17 is offered by the actuation of the elastically deformable region 4'c in the actuating handle 4'. This elastically deformable region 4'c is directly in contact with one end of the actuating shaft 13. The actuating shaft 13 of this embodiment is axially movable in the direction of the shaft 10 in a manner analogous to that of the first embodiment, so that a pressure on the elastically deformable region 4'c is transferred directly to the actuating shaft 13 and in a manner analogous to that of the first embodiment disengages the coupling and releases the cable pulley 14. So long as the pressure is maintained the cable pulley 14 with the planetary gear is freely movable, so that the tension in the traction element 17 can be released.

If the pressure on the elastically deformable region 4'c is relieved, then the actuating shaft 13 is moved upwards by the force of the spring 36 so that the two coupling parts 22 and 23 again come into engagement.

As already explained in the first embodiment, the user is given the possibility of releasing the closure without having to bend down for the purpose of actuating the locking arrangement. The pressure on the elastically deformable region 4'c can again be applied with the foot, a ski stick or another aid.

The second embodiment (FIGS. 4 to 6) is distinguished over the first embodiment (FIGS. 1 to 3) by a smaller overall height and easier assembly.

I claim:

1. A rotary closure for a sports shoe, such as a ski shoe, comprising:

(a) a rotatable pulley for rotating a traction element connected to a closure element of the shoe;

(b) a manually rotatable actuating shaft having a handle thereon, said shaft being axially movable independently of said handle;

(c) a manually releasable locking mechanism for fixing the actuating shaft in a selected rotary position representative of a chosen position of the closure element; and (d) transmission means between the actuating shaft and the pulley for transmitting rotary motion of the shaft to the pulley, said transmission means including a planetary gear and releasable coupling means between the shaft and the pulley, said coupling means being releasable in response to axial movement of said shaft relative to said handle to disengage said pulley from said shaft.

2. Rotary closure as claimed in claim 1 characterised in that the actuating shaft is axially displaced toward said handle against spring force.

3. Rotary closure as claimed in claim 2 characterised in that the coupling means is constructed as a toothed coupling member having two coupling parts which are provided with teeth and of which one coupling part is fixed on one end of the actuating shaft and the other coupling part is coupled to the gear.

4. Rotary closure as claimed in claim 1 characterised in that the locking mechanism comprises a ring gear concentric with the actuating shaft and a catch engageable therewith, one of said ring gear and said catch being stationary and the other part being connected to the actuating shaft so as to be fixed against rotation.

5. Rotary closure as claimed in claim 2 characterised in that a pressure-actuated actuating knob is connected to an end of the actuating shaft remote from the coupling means for axial displacement of the actuating shaft.

6. Rotary closure as claimed in claim 5 characterised in that the actuating knob is provided with a recess to accommodate a spring which axially biases the actuating shaft such that the coupling means is disposed in an engaged position between the actuating shaft and the pulley.

7. Rotary closure as claimed in claim 1 characterised in that the actuating handle travels over an idle path and is then drivingly engaged to the actuating shaft so as to rotate the shaft.

8. Rotary closure as claimed in claims 5 or 6, characterised in that the actuating knob (26) forms a cover for the actuating handle (4) and is mounted in a groove (28) in the actuating handle (4) so as to be displaceable in the axial direction.

9. Rotary closure as claimed in claim 1, characterised in that the locking mechanism has a stationary toothed ring (38) which is concentric with the actuating shaft (13) and has a locking slide (37) which comes into engagement therewith, and the locking slide (37) is connected to the actuating shaft (13) so as to be fixed against rotation after covering an idle path.

10. Rotary closure as claimed in claim 1 characterised in that a spring is positioned about the actuating shaft to axially bias the actuating shaft such that the coupling means is disposed in an engaged position between the actuating shaft and the pulley.

11. Rotary closure as claimed in claim 2 or 7, characterised in that the actuating handle 4' has an elastically deformable region (4'c) which is connected to the end of the actuating shaft (13) facing away from the coupling for axial displacement of the actuating shaft.

12. Rotary closure for a sports shoe, such as a ski shoe, comprising:

(a) a rotatable pulley for winding and unwinding a traction element connected to a closure element of the shoe;

(b) an actuating mechanism for rotating the pulley, said actuating mechanism comprising a rotatable and axially movable actuating shaft having a handle connected thereto for manual rotation of the shaft and a pressure-actuated element connected to the shaft and received in the handle for actuation by the shoe user when standing upright, the element and the shaft being axially movable relative to the actuating handle when said element is pressed toward the shaft;

(c) releasable locking means for releasably fixing the actuating shaft in a selected rotary position; and (d) releasable coupling means between the actuating shaft and the pulley for transmitting shaft rotation to the pulley, said coupling means being operable upon pressing of the element toward the shaft to disengage the shaft and the pulley, whereby the pulley may be released for rotation to unwind the traction element.

13. Rotary closure as claimed in claim 12 characterised in that the actuating handle includes means for releasing the locking mechanism when said actuating handle is rotated in a direction to unwind the traction element.

* * * * *